US005329700A

United States Patent [19]

Ferraro et al.

[11] Patent Number: 5,329,700

[45] Date of Patent: Jul. 19, 1994

[54] FLEXIBLE RAZOR UNIT EMPLOYING EMBOSSED BLADES

[75] Inventors: Frank A. Ferraro, Trumbull; Vincent C. Motta, Norwalk, both of Conn.

[73] Assignee: Warner-Lambert Company, Morris Plains, N.J.

[21] Appl. No.: 54,584

[22] Filed: Apr. 29, 1993

[51] Int. Cl.[5] ..... B26B 21/16

[52] U.S. Cl. ..... 30/41; 30/50

[58] Field of Search ..... 30/50, 69, 41, 32, 346.53, 30/346.54, 346.55, 346.56, 346.6

[56] References Cited

U.S. PATENT DOCUMENTS 1,011,938 12/1911 Gaisman ..... 30/346.54

1,895,763 1/1933 Lubbertsmeier ..... 30/346.54

4,443,939 4/1984 Motta et al. ..... 30/49

4,854,043 8/1989 Chen ..... 30/50

FOREIGN PATENT DOCUMENTS 1017944 10/1957 Fed. Rep. of Germany ... 30/346.56

121415 12/1918 United Kingdom ..... 30/346.56

*Primary Examiner*—Richard K. Seidel

*Assistant Examiner*—Paul M. Heyrana, Sr.

*Attorney, Agent, or Firm*—Charles W. Almer, III

[57] ABSTRACT

A flexible, twin-blade wet-shaving razor unit employing at least one embossed blade for providing improved cutting effectiveness. The embossment increases the rigidity of the blade(s), which, in turn, decreases the amplitude of any vibration introduced into the blades.

10 Claims, 2 Drawing Sheets

FLEXIBLE RAZOR UNIT EMPLOYING EMBOSSED BLADES

BACKGROUND OF THE INVENTION

The present invention relates to a flexible, twin-blade razor unit and, more particularly, to a flexible, twin-blade razor unit employing at least one embossed blade for providing improved cutting effectiveness.

Today, the use of flexible wet-shaving razor units, such as disposable razors and cartridges, has become quite common. These flexible razor units, such as the ones disclosed in commonly-owned U.S. Pat. No. 4,854,043 and U.S. patent application Ser. No. 07/563,926 filed on Aug. 7, 1990, represent a significant advance in the shaving field. In particular, the flexible razor unit flexes in response to forces encountered during shaving, thereby enabling the razor unit to conform to the natural contour of the surface being shaved. In turn, this brings a greater portion of the blade(s) into effective, cutting contact with the surface being shaved.

With the advent of flexible, twin-blade razor units, additional design challenges have been brought to light], For example, it has become necessary to focus on the rigidity of the blades. More specifically, unlike the prior art units in which the blades could be rigidly fixed to the housing of the unit, the blades in a flexible razor must be allowed some degree of freedom. As will be apparent to those skilled in the art, without such freedom the blades would prevent, or at the least limit, the razor unit from flexing.

However, designing the razor unit so that the blades may move relative to one another hinders the ability of the designer to provide a razor unit in which the blades are rigidly fixed to the housing. This rigidity is important to the blades of a wet-shaving razor unit in that blade rigidity decreases the amplitude of vibration introduced into such blade during shaving. Ideally, the amplitude of this vibration should be maintained as low as possible to ensure that the razor unit is providing the user with a comfortable and close shave.

In addition, it is often desirable to employ a cleaning mechanism (e.g., the one-push cleaning mechanism disclosed in commonly-owned co-pending application Ser. No. 958,407) between the blade. The cleaning mechanism facilitates the process of removing shaving debris that becomes lodged between the blades during shaving. However, the inclusion of this cleaning mechanism in the razor unit further increases the difficulty of rigidifying the blade(s).

It would therefore be desirable to provide a flexible, wet-shaving razor unit in which the blades are afforded a degree of freedom to allow flexing, yet, at the same time, are provided with increased rigidity that, in turn, provides improved cutting effectiveness. This same razor unit should also be capable of employing a cleaning mechanism for removing debris that becomes lodged between the blades during shaving.

SUMMARY OF THE INVENTION

The present invention, which addresses the needs of the prior art, provides a flexible, twin-blade wet-shaving razor unit having improved cutting effectiveness. The razor unit includes both cap and seat blades, each of the blades having a cutting edge for shaving. At least one of the blades includes a plurality of embossments disposed substantially perpendicular to the cutting edge for increasing the rigidity of the cutting edge during shaving while allowing for flexing of such blade in response to forces encountered during shaving. The razor unit also includes a seat portion and a cap portion between which the blades of the razor unit are disposed. Finally, the razor unit includes a spacer disposed between the blades.

In a preferred embodiment, the embossments extend substantially across the width of the blade. The embossments are preferably formed in only side of the blade and are disposed substantially parallel to one another. The embossed blade(s) is positioned in the razor unit so that the embossment face away from the other blade.

In another preferred embodiment, a cleaning mechanism is disposed between the blades. This cleaning mechanism is employed to dislodge the debris that typically becomes lodged between the blades of a twin-blade razor unit during shaving.

Accordingly, the present invention provides a flexible, twin-blade razor unit that affords the blades sufficient freedom to allow flexing of the razor unit yet, at the same time, provides a blade(s) having increased rigidity that improves the cutting effectiveness of the unit. Moreover, the design of this razor unit allows a cleaning mechanism to be disposed between the blades.

DETAILED DESCRIPTION OF THE INVENTION

Figure 1:
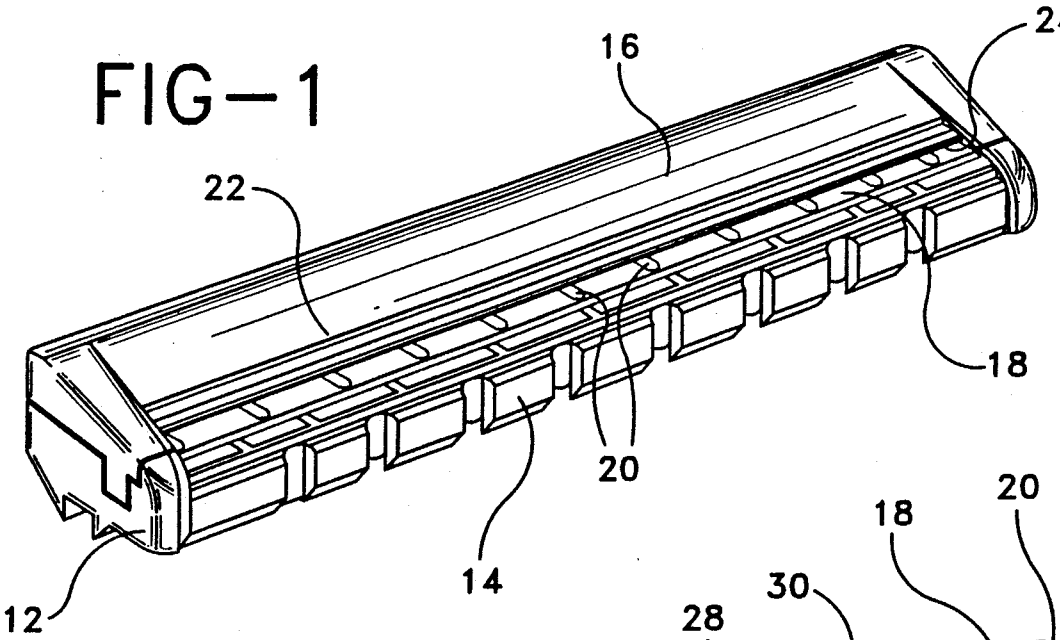
FIG. 1 is a perspective view of a flexible, twin-blade wet-shaving razor unit.

Referring to the drawings and, in particular, to FIG. 1, a flexible, twin-blade wet-shaving razor unit 10 is shown. Razor unit 10 includes a seat portion 12, a cap portion 16, a seat blade 18 having an upper side and a lower side, and a cap blade 22. The seat blade is formed with embossments. The embossments may be located on either the upper or the lower side of the blade. In the embodiment illustrated in FIG. 1, the embossments are located on the lower side of the seat blade. Indentations 21 are formed opposite the embossments.

In the illustrated embodiment, only seat blade 18 is formed with embossments. The blade is positioned in the razor unit so that these embossments face away from the cap blade, i.e., toward seat portion 12 and the indentations 21 face toward the cap blade. In this regard, seat portion 12 may be molded with channels to provide clearance for the downwardly-extending embossments. As will be apparent to those skilled in the art, cap blade 22 may also be formed with embossments. In such an embodiment, the embossments on the cap blade would face away from the seat blade, i.e., toward the cap portion.

Figure 2:
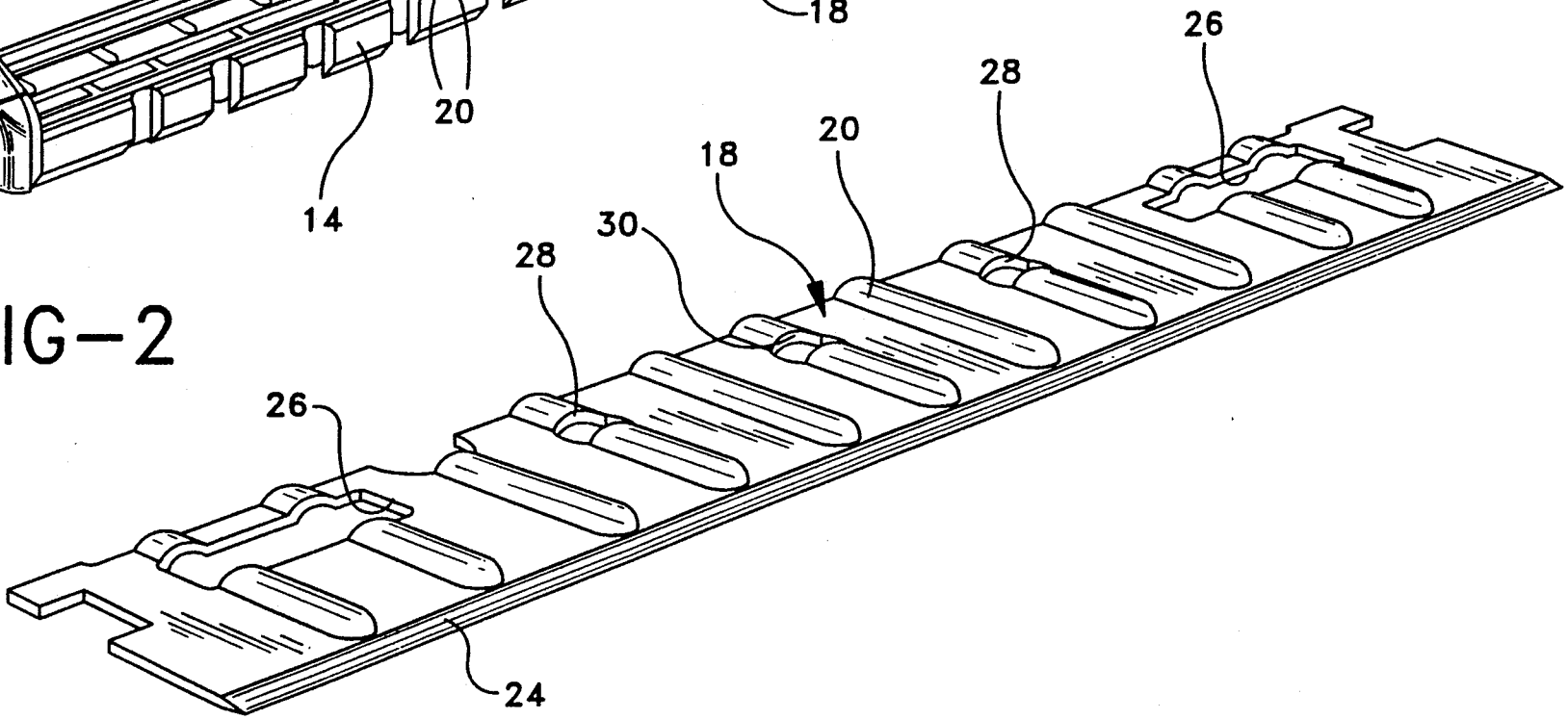
FIG. 2 is a perspective view of the embossed blade employed in the present invention.

Referring to FIG. 2, an embossed blade is shown. The embossments extend substantially across the blade and are disposed substantially perpendicular to cutting edge 24 of the blade. The inclusion of these embossments increase the rigidity of the blade, while, at the same time, still allowing the blade to flex in response to forces encountered during shaving.

Each of the blades includes a plurality of openings. For example, the blade illustrated in FIG. 2 includes a pair of rectangular openings 26, a pair of circular openings 28 and a centrally-positioned opening 30.

Figure 3:
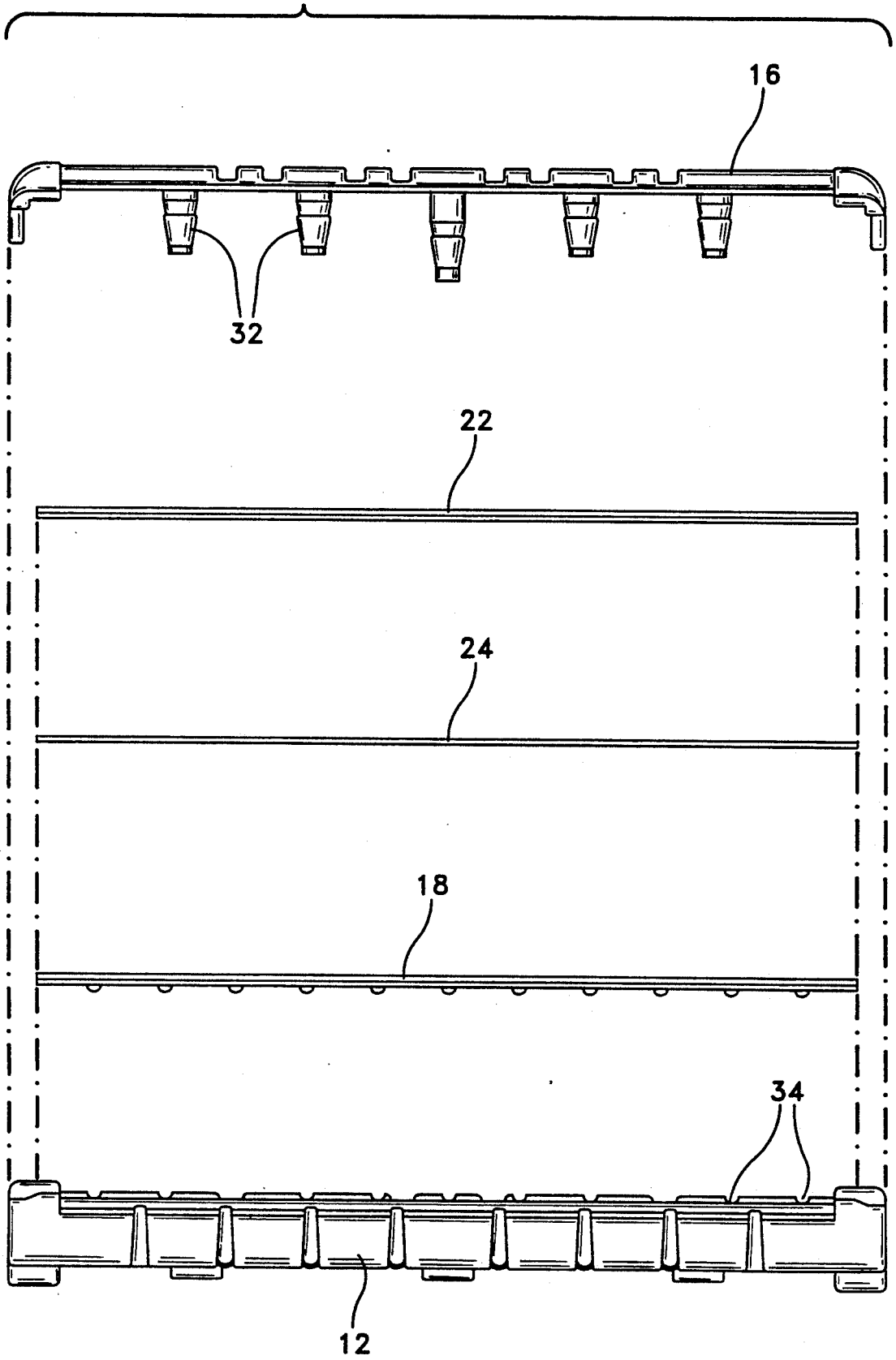
FIG. 3 is an exploded, elevational view of the components of the present invention.

Referring to FIG. 3, it can be seen that cap blade 22 and seat blade 18 are sandwiched between cap portion 16 and seat portion 12. A spacer 24 is, in turn, sandwiched between the blades. More specifically, cap portion 16 includes a plurality of securing pins 32 that pass through a series of co-linear openings (i.e., openings 26, 28 and 30) in the cap blade, spacer and seat blade. The securing pins are received by openings in seat portion 12 that are dimensioned so that pins 32 can be "snapped" in and, thereafter, not withdrawn. In addition, the pins are dimensioned so that once the unit is assembled, the components of such units are tightly sandwiched between the cap and seat portion. To allow relative movement of the blades and spacer during flexing, openings 26 are formed in the configuration of a slot and opening 28 are formed slightly larger in diameter than the diameter of the corresponding securing pins. This allows the components to slide past one another as the razor unit is flexed. The embossments 20 may be located on either the upper side or the lower side of the blade. In the embodiment illustrated in FIG. 3 the embossments 20 are on the lower side of the blade. Channels 34 are formed in the seat portion 12 in order to provide clearance for the downwardly-extending embossments 20.

Overall, the embossments formed in the blade increase the rigidity of such blade, which, in turn, decreases the amplitude of vibration introduced into the blade during shaving. Reduced amplitude translates into improved cutting effectiveness. In addition, the embossed blade minimizes the "lift effect" encountered during shaving. The "lift effect" is the tendency of the blade (e.g., the seat blade) to lift away from the seat portion when the cutting edge contacts a whisker or hair. Stated differently, the embossments on the blade decrease the amount of bending of the blade in the upward direction.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A flexible twin-blade wet-shaving razor unit providing improved cutting effectiveness comprising:

a cap blade and a seat blade, each of said blades having a cutting edge for shaving and wherein at least one of said blades includes a plurality of embossments disposed substantially perpendicular to said cutting edge for increasing the rigidity of said cutting edge during shaving while allowing for flexing of said at least one blade in response to forces encountered during shaving;

a seat portion and a cap portion, said blades disposed and secured for shaving between said seat and cap portion; and a spacer disposed between blades.

2. The razor unit according to claim 1, wherein said embossments extend substantially across the width of said at least one blade.

3. The razor unit according to claim 1, wherein said embossments are formed in one side of said at least one blade.

4. The razor unit according to claim 1, wherein said embossments in said at least one blade face away from the other blade.

5. The razor unit according to claim 4, wherein said embossments are disposed substantially parallel to one another.

6. The razor unit according to claim 1, wherein said embossments in said at least one blade face toward the other blade.

7. The razor unit according to claim 6, wherein said embossments are disposed substantially parallel to one another.

8. The razor unit according to claim 1, wherein each of said blades is embossed.

9. The razor unit according to claim 1, wherein said spacer is a cleaning mechanism.

10. The razor unit according to claim 1, wherein said embossments in said at least one blade face toward the other blade.

* * * * *